US005151566A

United States Patent [19]

Koyanagi et al.

[11] Patent Number: 5,151,566

[45] Date of Patent: Sep. 29, 1992

[54] GAS CIRCUIT BREAKER

[75] Inventors: Osamu Koyanagi; Yasuharu Seki; Masanori Tsukushi, all of Hitachi, Japan

[73] Assignee: Hitachi, Ltd., Tokyo, Japan

[21] Appl. No.: 635,251

[22] Filed: Dec. 28, 1990

[30] Foreign Application Priority Data

Jan. 8, 1990 [JP] Japan ..... 2-553

[51] Int. Cl.[5] ..... H01H 33/88

[52] U.S. Cl. ..... 200/110 A; 200/148 B; 200/148 R

[58] Field of Search ..... 200/148 A, 148 B, 148 R

[56] References Cited

U.S. PATENT DOCUMENTS 5,072,084 11/1990 Seki et al. ..... 200/148 A 5,079,392 6/1990 Tsukushi et al. ..... 200/148 A

*Primary Examiner*—A. D. Pellinen

*Assistant Examiner*—D. Le

*Attorney, Agent, or Firm*—Antonelli, Terry, Stout & Kraus

[57] ABSTRACT

A gas circuit breaker having a main fixed element and a main movable element capable of contacting and moving apart from each other, a fixed contact provided on the main fixed element side, a movable contact provided on the main movable element side and capable of contacting and moving apart form the fixed contact, an insulation nozzle provided on the main movable element side to surround the contacts, a hollow nozzle provided inside the movable contact, a cylinder, a puffer cylinder and a fixed piston provided on the main movable element. The insulating nozzle serves to compress a gas in a puffer chamber defined by the puffer cylinder and a fixed piston and to guide the gas to the gap between the contacts disconnected. The circuit breaker also has an opening formed in a side surface of the cylinder to discharge the gas from the insulation nozzle, a gas flow passage formed to provide a passage between the hollow nozzle and the opening, and an exhaust guide provided outside the main movable element to close the opening. The exhaust guide is divided into a plurality of guide members connected by releasable fixing device. One of these guide members can be moved relative to the others when the fixing device is released.

4 Claims, 4 Drawing Sheets

GAS CIRCUIT BREAKER

BACKGROUND OF THE INVENTION

This invention relates to a gas circuit breaker and, more particularly, to an improvement in a double flow type circuit breaker assembly indispensable to large-capacity circuit breakers.

To reduce the operating force of puffer type circuit breakers most popularly used for such a gas circuit breakers, self extinction combination design is ordinarily adopted whereby arc heat is positively utilized to increase the gas pressure and to thereby reduce the external operating force for gas compression. Also, for puffer type circuit breakers, a double flow method of blowing a pressurized gas to both the fixed side and the movable side is indispensable to large-current breaking.

In view of these circumstances, a double-flow puffer type circuit breaker has been proposed in which a gas pressurized by arc heat is effectively blown to the arc, and which is disclosed in U.S. Ser. No. 07/543,440 filed by the inventors of the present invention.

The circuit breaker described in U.S. Ser. No. 07/543,440 has a main fixed element and a main movable element as a main conductive part, a fixed contact provided on the main fixed element side, a movable contact provided on the main movable element side and capable of contacting and moving apart from the fixed contact, an insulation nozzle provided on the main movable element side to surround these contacts, a hollow nozzle provided inside the movable contact, a cylinder and a puffer cylinder on which the main movable element, the movable contact, the insulation nozzle and other members are fixed, and a fixed piston which, together with the puffer cylinder, defines a puffer chamber. A gas flow passage is formed in the hollow nozzle and has an opening in a side surface of the cylinder. An exhaust guide which closes this opening until the breaker is set in a suitable breaking position is formed on the periphery of the cylinder. However, the gas circuit breaker described in the prior application entails the problem of difficulty in inspecting the interior of the circuit breaker through a hand hole or the like of the casing in which the circuit breaker is housed, as well as in disassembling or assembling the fixed contact, the movable contact, the insulation nozzle and other members, because the exhaust guide is provided on the periphery of the cylinder.

SUMMARY OF THE INVENTION

It is an object of the present invention to provide a gas circuit breaker free from the above-described problem and capable of being easily inspected, disassembled and assembled from the outside of the casing in which the circuit breaker is housed.

To achieve this object, according to the present invention, there is provided a gas circuit breaker in which an exhaust guide is divided so that a divided front portion of the exhaust guide can be easily displaced from a hand hole or the like formed in a casing in which the circuit breaker is housed.

BRIEF DESCRIPTION OF THE DRAWINGS

FIG. 9 shows a closed state;

FIG. 10 shows a state corresponding to an initial breaking stage; and

FIG. 11 is a cross-sectional view of a state corresponding to an intermediate breaking stage.

DESCRIPTION OF THE PREFERRED EMBODIMENTS

The gas circuit breaker described in U.S. Ser. No. 07/543,440 and gas circuit breakers in accordance with the present invention will be described below with reference to the accompanying drawings.

Figure 9:
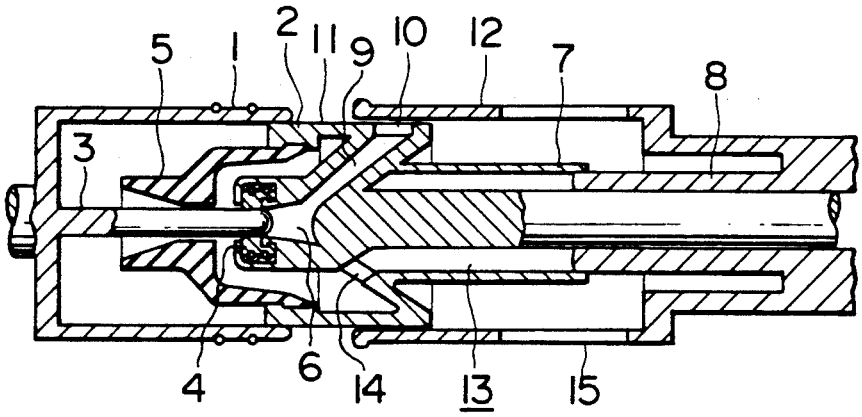
FIGS. 9, 10, and 11 are diagrams of the gas circuit breaker described in U.S. Ser. No. 07/543,440 prior to the present invention.
Figure 10:
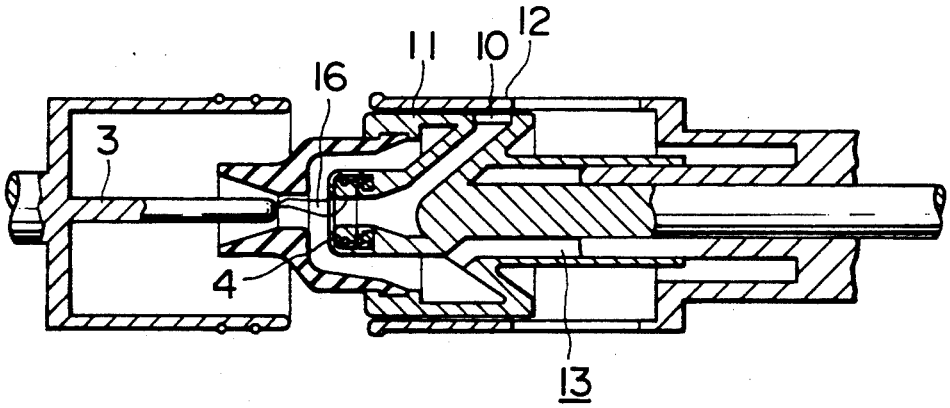
Figure 11:
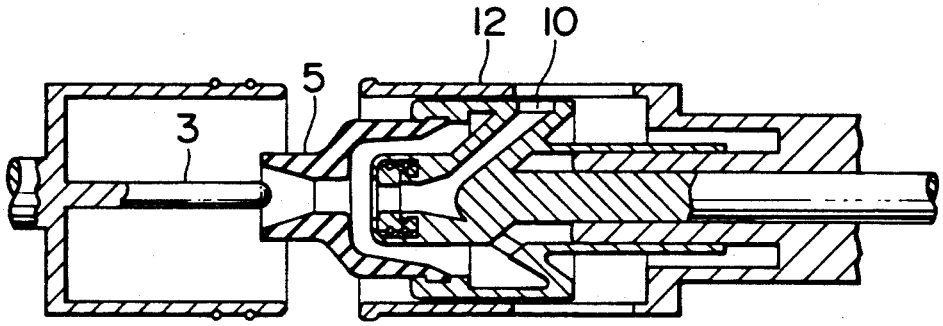

Referring to FIGS. 9, 10, and 11, the gas circuit breaker described in U.S. Ser. No. 07/543,440 has a main fixed element 1 and a main movable element 2 as a main conductive part, a fixed contact 3 provided on the main fixed element 1 side, a movable contact 4 provided on the main movable element 2 side and capable of contacting and moving apart from the fixed contact 3, an insulation nozzle 5 provided on the main movable element 2 side to surround these contacts, a hollow nozzle 6 provided inside the movable contact 4, a cylinder 11 and a puffer cylinder 7 on which the main movable element 2, the movable contact 4, the insulation nozzle 5 and other members are fixed, and a fixed piston 8 which, together with the puffer cylinder 7, defines a puffer chamber 13. A gas flow passage 9 is formed in the hollow nozzle 6 and has an opening 10 in a side surface of the cylinder 11. An exhaust guide 12 which closes the opening 10 until the breaker is set in a suitable breaking position is formed on the periphery of the cylinder 11. Reference numeral 14 and 15 respectively denote the gas supply hole and the exhaust holes.

FIG. 10 shows an initial breaking stage. An arc 16 is generated between the fixed contact 3 and the movable contact 4, and an arc extinguishing gas contained in the cylinder 11 and the puffer chamber 13 is thereby heated. At this time, however, the opening 10 of the movable contact 4 is closed by the exhaust guide 12 and no unnecessary gas flow is generated.

FIG. 11 shows an intermediate breaking stage. When the fixed contact comes off the insulation nozzle 5, the opening 10 on the movable side also comes out of the exhaust guide 12, so that gas flows in two directions are simultaneously generated to extinguish the arc 16.

Thus, this gas circuit breaker can be constructed as a double flow type having effects of reducing the length of the gas flow passage 9 on the movable side and, hence, the flow passage resistance, increasing the degree of freedom of setting the flow passage area or the exhaust area of the opening, and so on, and which is therefore capable of effectively blowing the gas.

In the gas circuit breaker described in the prior application, however, it is difficult to inspect the interior of the circuit breaker through a hand hole or the like of the casing in which the circuit breaker is housed, and to disassemble or assemble the fixed contact 3, the movable contact 4, the insulation nozzle 5 and other members, because the exhaust guide 12 is provided on the periphery of the circuit breaker.

Next, embodiments of the present invention will be described below with reference to FIGS. 1 to 8.

Figure 1:
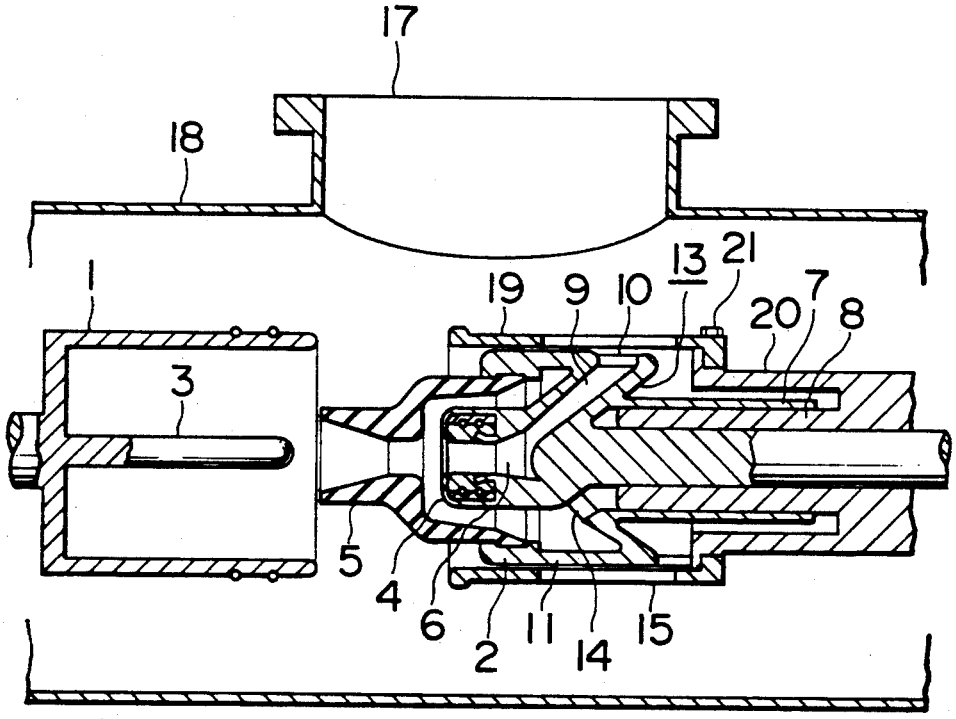
FIG. 1 is a cross-sectional view of a gas circuit breaker in accordance with the present invention.
Figure 2:
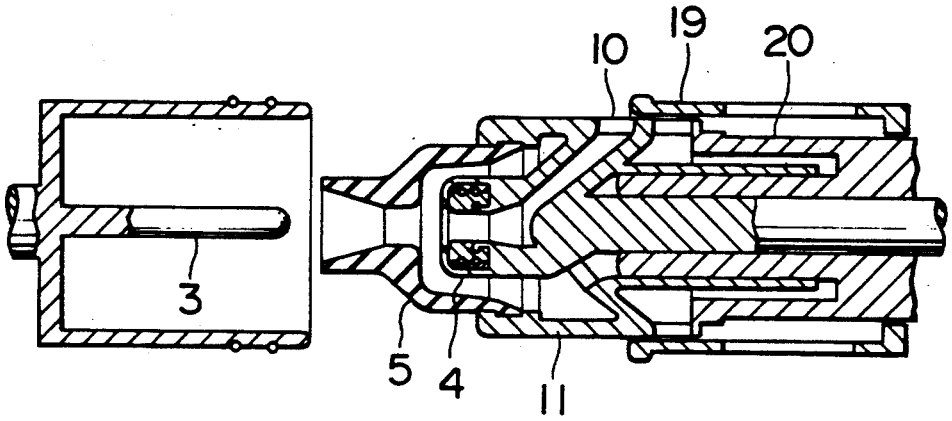
FIG. 2 is a cross-sectional view of a state in which an exhaust guide of the circuit breaker shown in FIG. 1 is moved.

FIG. 1 shows a circuit breaker housed in a casing 18 with a hand hole 17 in accordance with the present invention. Components corresponding or identical to those of the circuit breaker of the prior application shown in FIGS. 9 to 10 are indicated by the same reference characters. This circuit breaker differs form the breaker of the prior application in that the exhaust guide 12 is divided into two guide members 19 and 20 in the axial direction which are connected by a bolt 21, and that the guide member 19 can be made movable in the axial direction relative to the other guide member 20 by removing the bolt 21. FIG. 2 shows a state in which the bolt 21 is removed through the hand hole shown in FIG. 1, and in which the guide member 19 is axially moved to the movable side. Thus, the exhaust guide is divided into the guide members 19 and 20 so as to be movable, so that the insulation nozzle 5, the peripheral portion of the cylinder 11, the opening 10 and other members can easily be inspected through the hand hole 17, and that disassembly and assembly of the fixed contact 3, the movable contact 4, the insulation nozzle 5 and other members are also facilitated.

Figure 3:
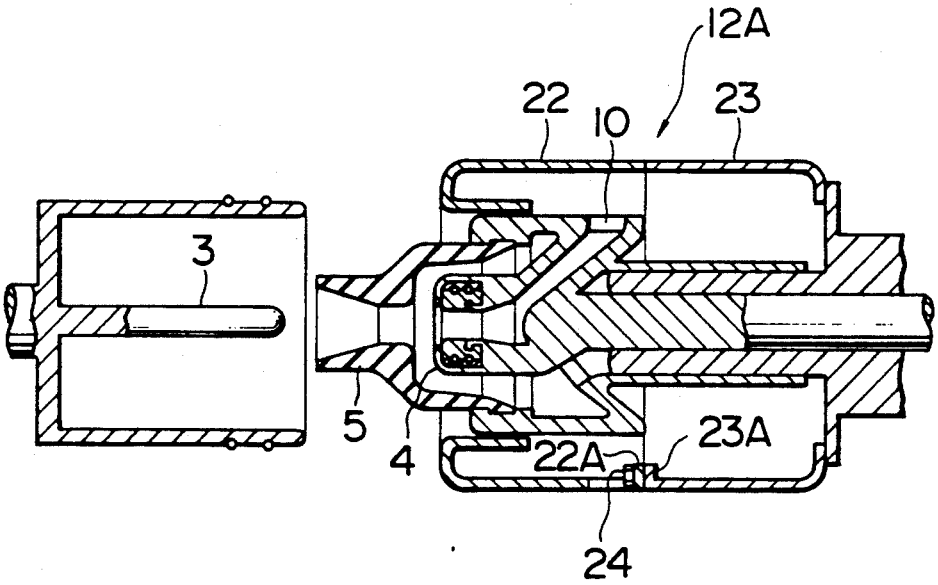
FIG. 3 is cross-sectional view of a second embodiment of the present invention.

FIG. 3 shows the second embodiment provided with an exhaust guide 12A which also has a function of preventing the high-temperature gas discharged through the opening 10 from directly reaching the casing 18 at the time of breaking operation, and which is divided into guide members 22 and 23. Flanges 22A and 23A formed on inner portions of the guide members 22 and 23 are detachably connected by a bolt 24. FIGS. 3 and 5 shows perspective views of the guide members 22 and 23. A shown in FIG. 4, the guide members 22 and 23 have a plurality of cutouts 25 and 26 which do not face the opening 10, and projections 25A and 26A formed between the adjacent cutouts. The guide member 22 is moved to the movable side in such a manner that the bolt 24 is removed and the guide member 22 is thereafter rotated in the circumferential direction by a certain angle, and the projections 26A and 25A are inserted into the cutouts 25 and 26, thereby enabling the guide member to be moved in the axial direction relative to the other guide member 23. The same effect as the embodiment shown in FIG. 1 can be obtained.

Figure 4:
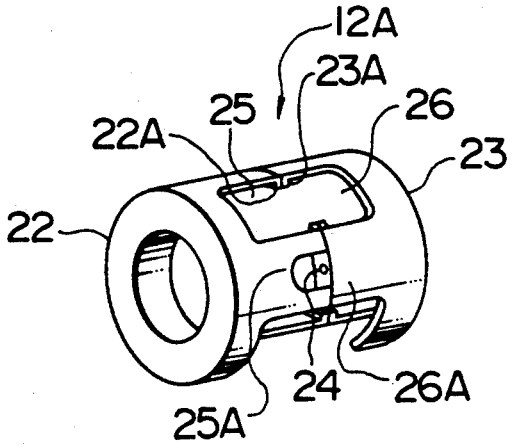
FIG. 4 is a perspective view of a state before an exhaust guide of the embodiment shown in FIG. 3.
Figure 5:
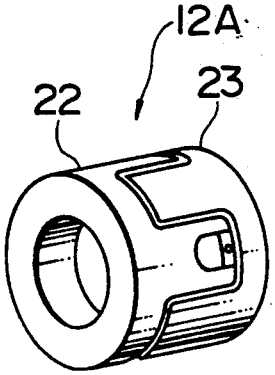
FIG. 5 is a perspective view of a state in which the exhaust guide shown in FIG. 4 is moved.
Figure 6:
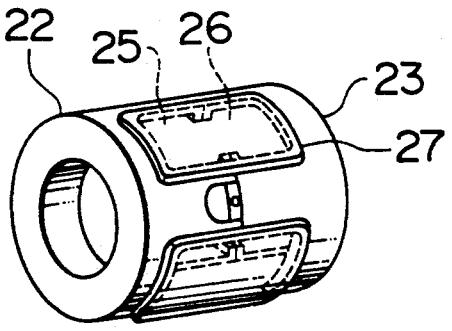
FIG. 6 is a perspective view of an exhaust guide of a third embodiment of the present invention.

FIG. 6 shows the third embodiment in which gas shield plates 27 are provided outside the cutouts 25 and 26 equal to those of the embodiments shown in FIG. 4, and these plates are fixed to the guide member 22 by bolts (not shown) or by welding. This construction ensures that the gas having a high temperature increased with the increase in the current can be prevented from being discharged outside the guide members 22 and 23.

Figure 7:
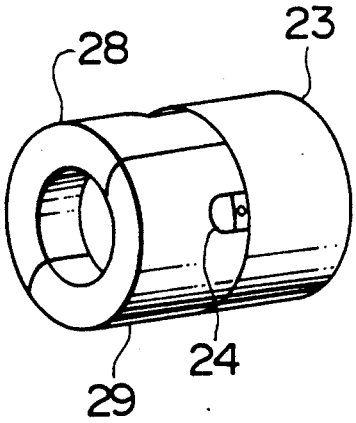
FIG. 7 is a perspective view of an exhaust guide of a fourth embodiment of the present invention.

FIG. 7 shows the fourth embodiment provided with guide members 28 and 29 formed by further dividing the guide member 22 of the embodiment shown in FIG. 3. According to this embodiment, there is no need for gas shield plates such as those shown in FIG. 6.

Figure 8:
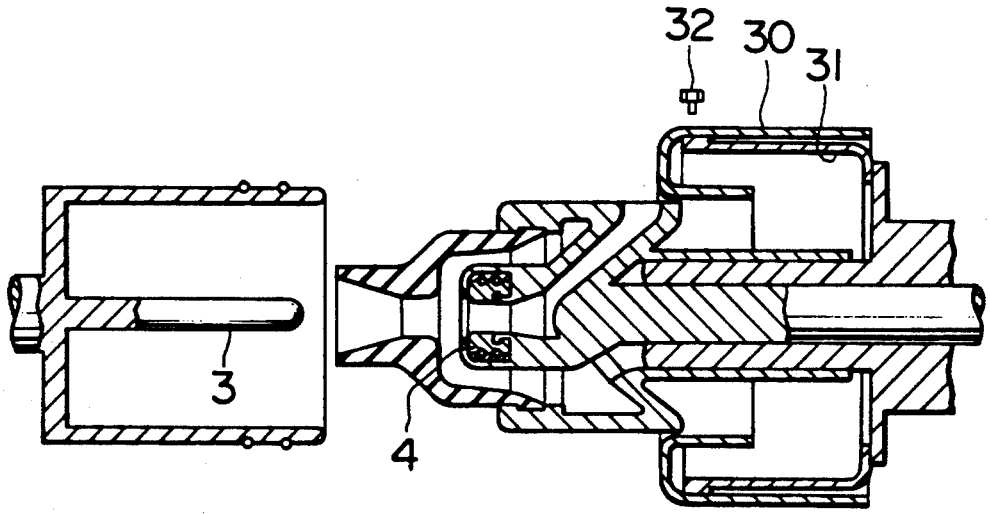
FIG. 8 is a cross-sectional view of a fifth embodiment of present invention.

FIG. 8 shows the fifth embodiment formed by further modifying the embodiment shown in FIG. 3. Guide members 30 and 31 having different outside diameters are provided. The guide member 30 is movable in the axial direction relative to the other guide member 31. A reference numeral 32 denotes a bolt for connecting the guide members 30 and 31. This arrangement also enables the same effects as the embodiment shown in FIG. 1.

What is claimed is:

1. A gas circuit breaker comprising:

a main fixed element and a main movable element capable of contacting and moving apart from each other;

a fixed contact provided on the side of said main fixed element;

a movable contact provided on the side of said main movable element and capable of contacting and moving away from said fixed contact;

a hollow nozzle provided inside said movable contact;

a cylinder, a puffer cylinder and a fixed piston provided on said main movable element;

an insulation nozzle surrounding said movable contact, said insulating nozzle being capable of compressing a gas in a puffer chamber defined by said puffer cylinder and said fixed piston and capable of guiding the gas to an opening when said contacts are disconnected;

an opening formed in a side surface of said cylinder to discharge the gas from said hollow nozzle;

a gas flow passage formed to provide a passage between said hollow nozzle and said opening; and an exhaust guide provided outside said main movable element to close said opening;

wherein said exhaust guide is divided into a plurality of guide members connected by releasable fixing device.

2. A gas circuit breaker according to claim 1, wherein said exhaust guide has two guide members divided at dividing portions extending in a circumferential direction, each of said guide members divided along the circumferential direction having a plurality of cutouts and a plurality of projections alternately disposed, the cutouts and projections of one of said guide members being fitted to the projections and the cutouts of the other guide member.

3. A gas circuit breaker according to claim 2, further comprising a gas shield plate provided outside said cutouts.

4. A gas circuit breaker according to claim 1, wherein said exhaust guide has two guide members having different diameters, said two guide members being connected by a releasable fixing device so that one of said guide members can be slid in the axial direction relative to the other when said fixing device is released.

* * * * *